US010322837B2

(12) United States Patent
Bysick et al.

(10) Patent No.: US 10,322,837 B2
(45) Date of Patent: Jun. 18, 2019

(54) HOT FILL CONTAINER HAVING SUPERIOR CRUSH RESISTANCE

(75) Inventors: Scott E. Bysick, Elizabethtown, PA (US); Paul V. Kelley, Wrightsville, PA (US)

(73) Assignee: GRAHAM PACKAGING COMPANY, L.P., York, PA (US)

( * ) Notice: Subject to any disclaimer, the term of this patent is extended or adjusted under 35 U.S.C. 154(b) by 73 days.

(21) Appl. No.: 13/476,436

(22) Filed: May 21, 2012

(65) Prior Publication Data

US 2013/0306660 A1 Nov. 21, 2013

(51) Int. Cl.
*B65D 1/02* (2006.01)

(52) U.S. Cl.
CPC .... *B65D 1/0223* (2013.01); *B65D 2501/0036* (2013.01)

(58) Field of Classification Search
CPC ..... B65D 1/40; B65D 1/42; B29C 49/04
USPC ..... 220/675
See application file for complete search history.

(56) References Cited

U.S. PATENT DOCUMENTS

| | | | | | |
|---|---|---|---|---|---|
| 5,803,290 | A | * | 9/1998 | Bongiorno | 215/384 |
| D448,670 | S | * | 10/2001 | Bretz et al. | D9/520 |
| D608,209 | S | * | 1/2010 | Lepoitevin | D9/538 |
| 2007/0090083 | A1 | | 4/2007 | Trude et al. | |
| 2011/0088360 | A1 | | 4/2011 | Shah et al. | |

OTHER PUBLICATIONS

International Search Report and Written Opinion for PCT/US2013/042013, dated Aug. 27, 2013.

* cited by examiner

*Primary Examiner* — Fenn C Mathew
(74) *Attorney, Agent, or Firm* — Baker Botts L.L.P.

(57) ABSTRACT

A hot fill plastic container has a dome portion with a convex outer surface that defines a maximum outer diameter of the container so as to extend outwardly beyond a main body portion of the container. The generally egg-shaped dome portion enhances the crush resistance of the dome and provides a point of contact between containers when they are placed adjacent to one another. A circumferential stiffening groove may be provided near a lower end of the dome portion.

36 Claims, 3 Drawing Sheets

HOT FILL CONTAINER HAVING SUPERIOR CRUSH RESISTANCE

BACKGROUND OF THE INVENTION

1. Field of the Invention

This invention relates generally to the field of blow molded plastic containers, and specifically to a hot fill type container having a dome portion that is shaped to provide superior crush resistance.

2. Description of the Related Technology

Many products that were previously packaged using glass containers are now being supplied in plastic containers, such as containers that are fabricated from polyesters such as polyethylene terephthalate (PET).

PET containers are typically manufactured using the stretch blow molding process. This involves the use of a preform that is injection molded into a shape that facilitates distribution of the plastic material within the preform into the desired final shape of the container. The preform is first heated and then is longitudinally stretched and subsequently inflated within a mold cavity so that it assumes the desired final shape of the container. As the preform is inflated, it takes on the shape of the mold cavity. The polymer solidifies upon contacting the cooler surface of the mold, and the finished hollow container is subsequently ejected from the mold.

Hot fill containers are designed to be used with the conventional hot fill process in which a liquid or semi-solid product such as fruit juice, sauce, salsa, jelly or fruit salad is introduced into the container while warm or hot, as appropriate, for sanitary packaging of the product. After filling, such containers undergo significant volumetric shrinkage as a result of the cooling of the product within the sealed container. Hot fill type containers accordingly must be designed to have the capability of accommodating such shrinkage. Typically this has been done by incorporating one or more vacuum panels into the side wall of the container that are designed to flex inwardly as the volume of the product within the container decreases as a result of cooling. However, some hot fill type containers are designed without vacuum panels, and are engineered to assume vacuum uptake through inward deflection of features of the container, such as the dome portion.

The dome portion of a blow molded plastic container forms the shoulder of the container and is typically positioned between an upper finish portion that defines an opening and is designed to receive a closure. The dome portion of certain types of predecessor hot fill containers was prone to denting as a result of physical contact and vacuum forces within the container. While it is possible to strengthen the dome portion by engineering it to have a thicker sidewall, this is problematic in the sense that it requires more material to make the container, which adds to the expense of the container.

A need therefore exists for a hot fill container having a dome configuration that provides superior crush resistance with respect to predecessor containers without significantly increasing material costs.

SUMMARY OF THE INVENTION

Accordingly, it is an object of the invention to provide a hot fill container having a dome configuration that provides superior crush resistance with respect to predecessor containers without significantly increasing material costs.

In order to achieve the above and other objects of the invention, a plastic container according to one aspect of the invention includes a finish portion that defines an opening, a bottom portion and a substantially cylindrical main body portion having a first maximum diameter. The container further includes a dome portion having a first curved portion and a second curved portion that has a different curvature than the first curved portion. The dome portion also defines a second maximum diameter that is greater than the first maximum diameter.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
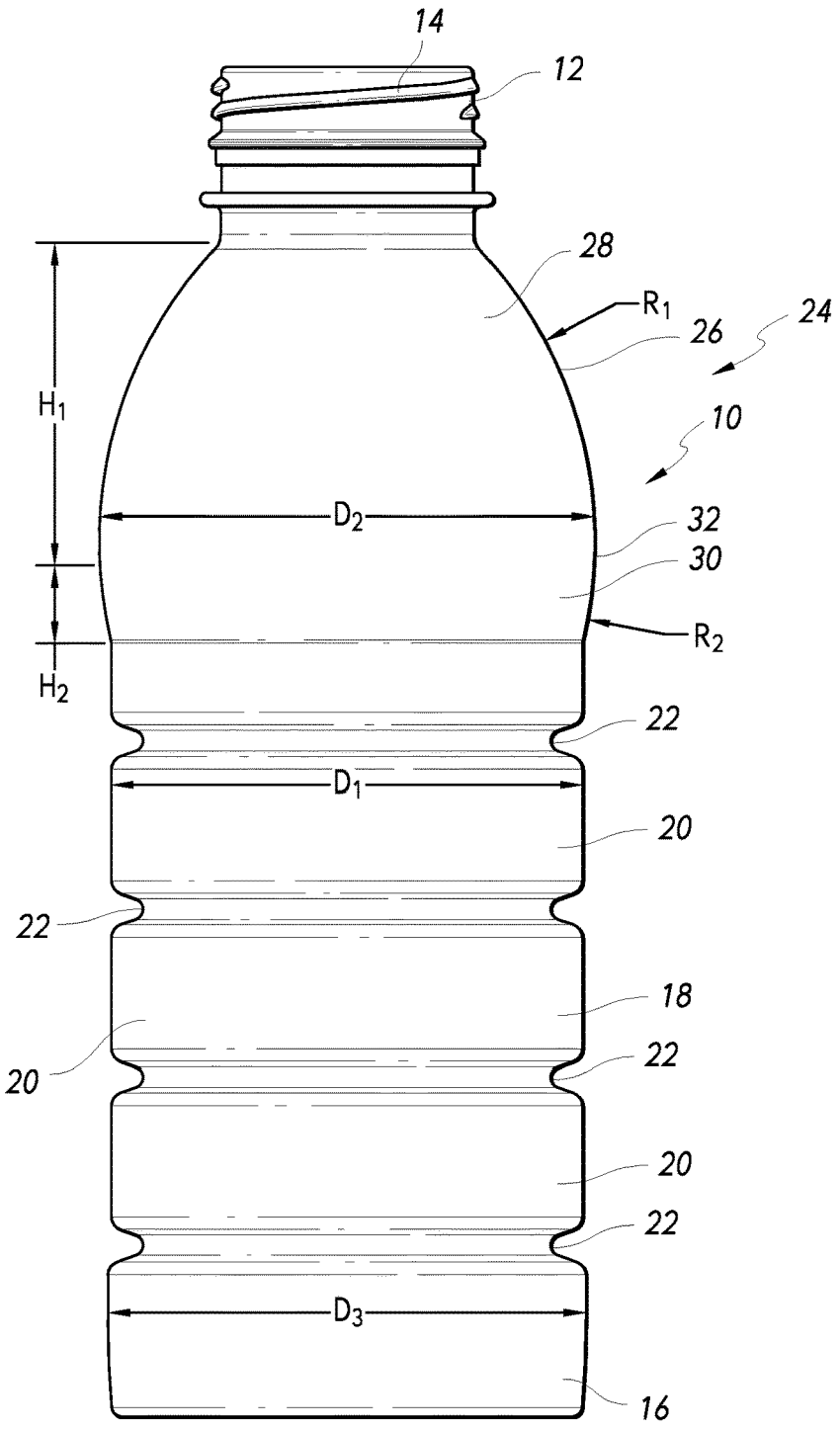
FIG. 1 is a front elevational view depicting a plastic container that is constructed according to a first embodiment of the invention.

Referring now to the drawings, wherein like reference numerals designate corresponding structure throughout the views, and referring in particular to FIG. 1, a hot fill plastic container 10 that is constructed according to a first embodiment of the invention includes a finish portion 12 that defines an opening communicating with an interior of the plastic container 10. In this embodiment, finish portion 12 includes at least one helical thread 14 that is adapted to receive a closure.

Hot fill plastic container 10 is preferably fabricated from a material such as polyethylene terephthalate (PET) using a conventional stretch reheat blow molding process. Alternatively, plastic container 10 could be fabricated using an extrusion blow molding technique, from a material such as polyethylene, polypropylene or polyolefin.

Plastic container 10 includes a bottom portion 16, which is preferably shaped so as to be substantially cylindrical and to define a standing ring that permits the container 10 to be stably supported by an underlying horizontal surface. Container 10 further includes a substantially cylindrical main body portion 18, which in the preferred embodiment includes a plurality of cylindrical sidewall portions 20 that are separated by a corresponding plurality of stiffening grooves 22. The main body portion 18 has a first maximum outer diameter $D_1$, as is shown in FIG. 1.

Plastic container 10 further includes a dome portion 24 positioned between the main body portion 18 and the finish portion 12. Dome portion 24 defines a second maximum diameter $D_2$, which is preferably greater than the first maximum diameter $D_1$ of the main body portion 18. The cylindrical sidewall of the bottom portion 16 defines a third maximum outer diameter $D_3$, which preferably is greater than the maximum outer diameter $D_1$ of the main body portion 18 and substantially the same as the maximum outer diameter $D_2$ of the dome portion 24.

The dome portion 24 preferably has a convex outer surface 26 that is shaped so as to define a first convex portion 28 that has a first average radius of curvature $R_1$. In the preferred embodiment, the first average radius of curvature $R_1$ is substantially constant. The convex outer surface 26 further includes a second convex portion 30 having a second average radius of curvature $R_2$, which in the preferred embodiment is also substantially constant. A transition region 32 connects the first and second convex portions 28, 30.

The dome portion 24 preferably has an egg-shaped appearance, as may be seen in FIG. 1. Dome portion 24 is also shaped so as to be substantially symmetrical about a longitudinal axis. In the preferred embodiment, the main body portion 18 and the bottom portion 16 are also shaped so as to be substantially symmetrical about the longitudinal axis of the container 10.

In this embodiment, the transition region 32 is preferably located near the portion of the convex outer surface 26 that defines the maximum outer diameter $D_2$. The compound curve shape created by the first and second convex portions 28, 30 creates a stiffening effect at the transition region 32 that provides enhanced crush resistance at the point that the dome portion 24 is expected to make contact with adjacent containers or to be gripped by a consumer.

The second radius of curvature $R_2$ of the second convex portion 30 is preferably greater than the first radius of curvature $R_1$ of the first convex portion 28. A ratio $R_1/R_2$ of the first radius of curvature $R_1$ to the second radius of curvature $R_2$ is preferably substantially within a range of about 0.3 to about 0.9, more preferably substantially within a range of about 0.4 to about 0.8 and most preferably substantially within a range of about 0.5 to about 0.7.

A ratio $R_1/D_2$ of the first radius of curvature $R_1$ to the maximum diameter $D_2$ of the dome portion is preferably substantially within a range of about 0.4 to about 1.2, more preferably substantially within a range of about 0.55 to about 1.05 and most preferably substantially within a range of about 0.7 to about 0.9.

A ratio of the first maximum outer diameter $D_1$ of the main body portion 18 to the second maximum outer diameter $D_2$ of the dome portion 24 is preferably substantially within a range of about 0.8 to about 0.99, more preferably substantially within a range of about 0.85 to about 0.98 and most preferably substantially within a range of about 0.9 to about 0.97.

As FIG. 1 shows, the first convex portion 28 of the dome portion 24 defines a first vertical height $H_1$, and the second convex portion 30 defines a second vertical height $H_2$. Preferably, the first vertical height $H_1$ is greater than the second vertical height $H_2$. A ratio $H_1/H_2$ of the first vertical height $H_1$ to the second vertical height $H_2$ is preferably substantially within a range of about 1.0 to about 7.0 and more preferably substantially within a range of about 2.0 to about 6.0.

Figure 2:
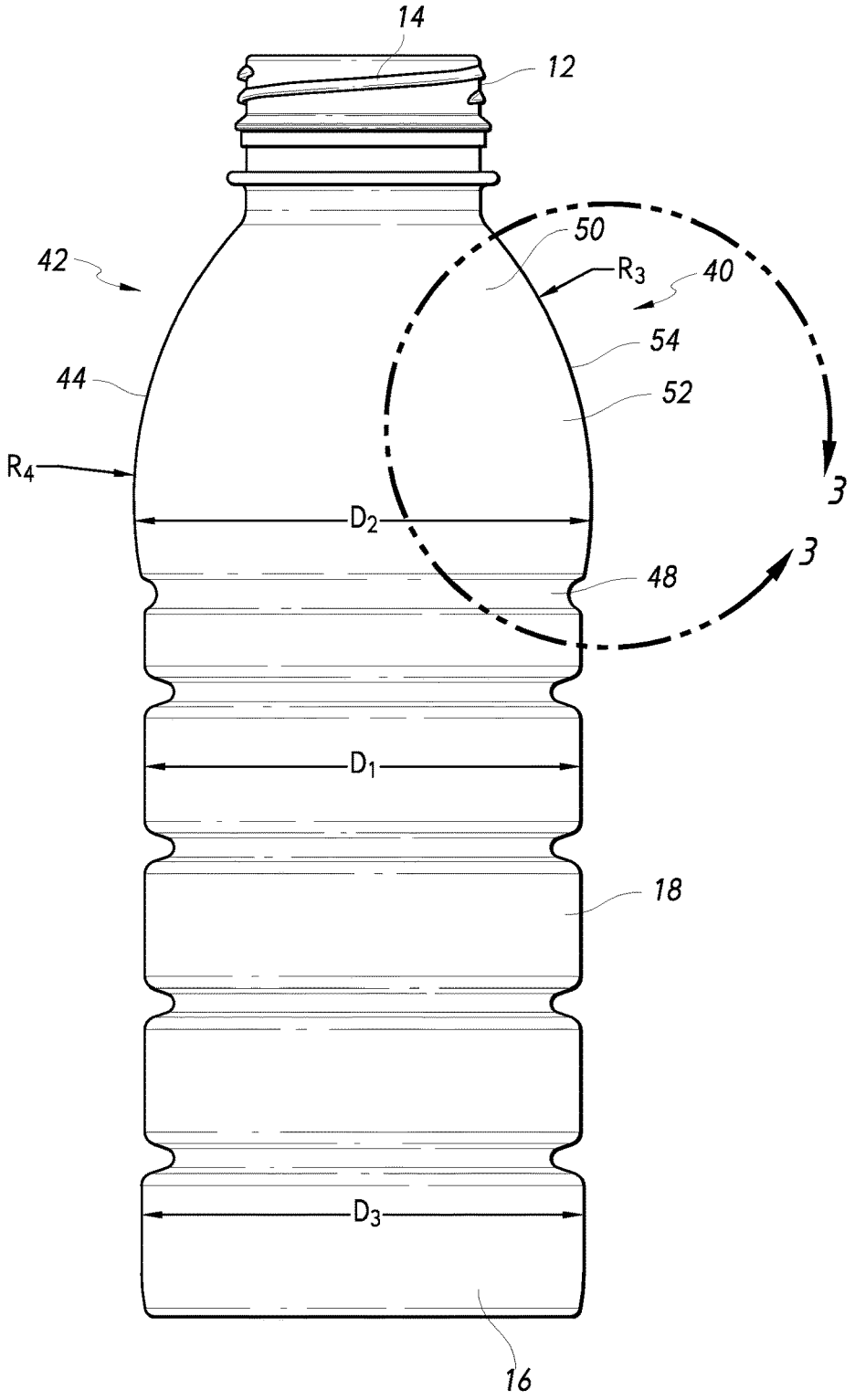
FIG. 2 is a front elevational view depicting a plastic container that is constructed according to a second, preferred embodiment of the invention.
Figure 3:
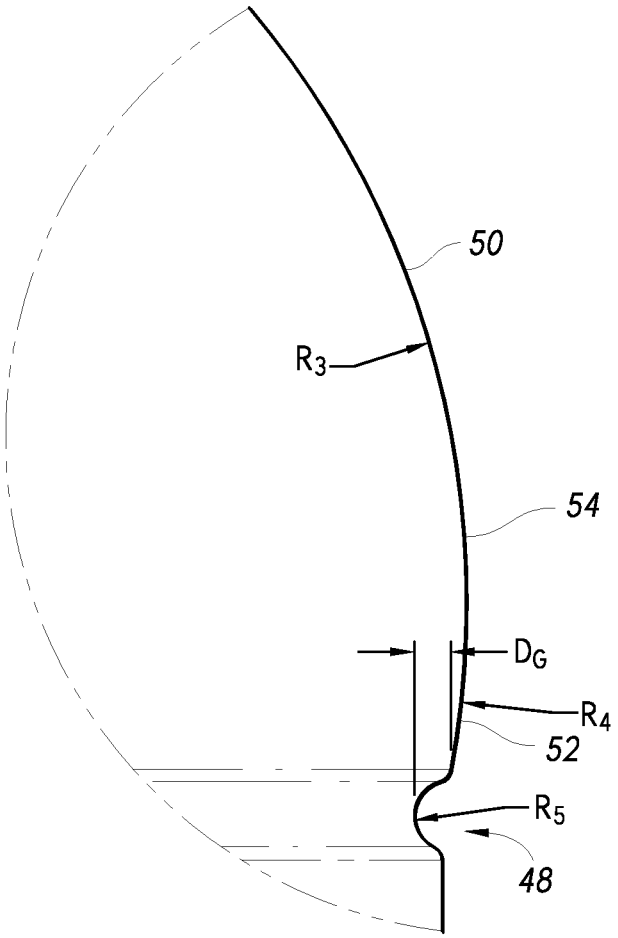
FIG. 3 is a fragmentary view depicting a portion of the plastic container that is shown in FIG. 2.

A hot fill plastic container 40 that is constructed according to a second, preferred embodiment of the invention is depicted in FIG. 2. Container 40 preferably includes a finish portion 12, a bottom portion 16 and a main body portion 18, all of which are preferably constructed so as to be substantially the same as described above with respect to the first embodiment.

Container 40 further includes a dome portion 42 defining a convex outer surface having a first convex portion 50 having an average radius of curvature $R_3$, which in the preferred embodiment is substantially constant. Dome portion 42 further defines a second convex portion 52 having an average radius of curvature R4, which is also preferably substantially constant. A transition region 54 connects the first and second convex portions 50, 52. In this embodiment, the maximum outer diameter of the dome portion 42 is positioned below the transition region 54 and defined by the second convex portion 52.

As was described above with respect to the first embodiment, the dome portion 42 defines a maximum outer diameter $D_2$ that is preferably greater than the maximum outer diameter $D_1$ of the main body portion 18 and preferably substantially the same as the maximum outer diameter $D_3$ of the bottom portion 16.

Dome portion 42 advantageously has a circumferential groove 48 defined near a lowermost end thereof. The circumferential groove 48 provides additional stiffening to the dome portion 42, which enhances its crush resistance. The circumferential groove 40 preferably extends around the entire circumference of the lower part of the dome portion 42. Circumferential groove 40 further preferably has an average concave radius of curvature $R_5$ and a maximum depth $D_G$.

Preferably, a ratio $D_G/D_2$ of the depth DG of the groove 48 to the maximum outer diameter $D_2$ of the dome portion 42 is substantially within a range of about 0.01 to about 0.15, more preferably substantially within a range of about 0.02 to about 0.10 and most preferably substantially within a range of about 0.03 to about 0.09.

A ratio $R_5/D_G$ of the average concave radius of curvature $R_5$ of the groove 40 to the depth $D_G$ of the groove 48 is preferably substantially within a range of about 0.2 to about 1.0, more preferably substantially within a range of about 0.35 to about 0.9 and most preferably substantially within a range of about 0.5 to about 0.8.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A plastic container, comprising:

a finish portion defining an opening;

a main body portion comprising a cylindrical sidewall having a first maximum diameter in plan view;

a dome portion between the finish portion and the main body portion, the dome portion having, as viewed in longitudinal section:

an upper end disposed proximate to the finish portion, a lowermost end disposed adjacent to the main body portion, a first convex curved portion defining a first constant radius of curvature, a second convex curved portion defining a second constant radius of curvature that is greater than the first radius of curvature, and a convex curved non-cylindrical transition portion having a transition curvature connecting the first curved portion and the second curved portion, wherein the first convex curved portion extends from the upper end of the dome portion to the transition portion and the second convex curved portion extends from the transition portion to the lowermost end of the dome portion, the dome portion further having a second maximum diameter in plan view that is greater than the first maximum diameter; and a bottom portion having a standing ring and a cylindrical sidewall extending between the main body portion and the standing ring, the cylindrical sidewall having a third maximum diameter.

2. A hot fill plastic container according to claim 1, wherein a ratio of the first radius of curvature to the second radius of curvature is within a range of 0.3 to 0.9.

3. A plastic container according to claim 2, wherein the ratio of the first radius of curvature to the second radius of curvature is within a range of 0.4 to 0.8.

4. A plastic container according to claim 3, wherein the ratio of the first radius of curvature to the second radius of curvature is within a range of 0.5 to 0.7.

5. A plastic container according to claim 1, wherein a ratio of the first radius of curvature to the second maximum diameter of the dome portion is within a range of 0.4 to 1.2.

6. A plastic container according to claim 5, wherein the ratio of the first radius of curvature to the second maximum diameter of the dome portion is within a range of 0.55 to 1.05.

7. A plastic container according to claim 6, wherein the ratio of the first radius of curvature to the second maximum diameter of the dome portion is within a range of 0.7 to 0.9.

8. A plastic container according to claim 1, wherein a ratio of the first maximum diameter to the second maximum diameter is within a range of 0.8 to 0.99.

9. A plastic container according to claim 8, wherein the ratio of the first maximum diameter to the second maximum diameter is within a range of 0.85 to 0.98.

10. A plastic container according to claim 9, wherein the ratio of the first maximum diameter to the second maximum diameter is within a range of 0.9 to 0.97.

11. A plastic container according to claim 1, wherein the first convex portion of the dome portion defines a first vertical height and the second convex portion of the dome portion defines a second vertical height, and wherein a ratio of the first vertical height to the second vertical height is within a range of 1.0 to 7.0.

12. A plastic container according to claim 11, wherein the ratio of the first vertical height to the second vertical height is within a range of 2.0 to 6.0.

13. A plastic container according to claim 1, further comprising a circumferential groove defined proximate to the lowermost end of the dome portion, the circumferential groove having a concave radius of curvature $R_5$ and a maximum depth $D_G$, wherein a ratio of the concave radius of curvature $R_5$ to the maximum depth $D_G$ is within a range of about 0.20 to about 1.0.

14. A plastic container according to claim 1, wherein the dome portion has an egg-shaped appearance.

15. A plastic container according to claim 1, wherein the dome portion is shaped so as to be symmetrical about a longitudinal axis.

16. A plastic container according to claim 1, wherein the main body portion further comprises a plurality of stiffening grooves.

17. A plastic container according to claim 16, wherein the main body portion further comprises a plurality of cylindrical sidewall portions separated by said plurality of stiffening grooves.

18. A plastic container according to claim 1, wherein the second maximum diameter is defined by the second convex curved portion.

19. The plastic container according to claim 1, wherein an uppermost portion of the main body portion is a cylindrical sidewall.

20. The plastic container according to claim 1, wherein the third maximum diameter is the same as the second maximum diameter.

21. A plastic container, comprising:

a finish portion defining an opening;

a main body portion comprising a cylindrical sidewall having a first maximum diameter in plan view a dome portion between the finish portion and the main body portion, the dome portion having, as viewed in longitudinal section:

an upper end disposed proximate to the finish portion, a lowermost end disposed adjacent to the main body portion, a first convex curved portion defining a first constant radius of curvature, a second convex curved portion defining a second constant radius of curvature that is greater than the first radius of curvature, and a convex curved non-cylindrical transition portion having a transition curvature connecting the first curved portion and the second curved portion, wherein the first convex curved portion extends from the upper end of the dome portion to the transition portion and the second convex curved portion extends from the transition portion to the lowermost end of the dome portion, the dome portion further having a second maximum diameter in plan view that is greater than the first maximum diameter, the second maximum diameter defined by the second convex curved portion; and a bottom portion having a standing ring and a cylindrical sidewall extending between the main body portion and the standing ring, the cylindrical sidewall having a third maximum diameter.

22. A hot fill plastic container according to claim 21, wherein a ratio of the first radius of curvature to the second radius of curvature is within a range of 0.3 to 0.9.

23. A plastic container according to claim 21, wherein a ratio of the first radius of curvature to the second maximum diameter of the dome portion is within a range of 0.4 to 1.2.

24. A plastic container according to claim 21, wherein a ratio of the first maximum diameter to the second maximum diameter is within a range of 0.8 to 0.99.

25. A plastic container according to claim 21, wherein the first convex portion of the dome portion defines a first vertical height and the second convex portion of the dome portion defines a second vertical height, and wherein a ratio of the first vertical height to the second vertical height is within a range of 1.0 to 7.0.

26. A plastic container according to claim 21, further comprising a circumferential groove defined proximate to the lowermost of the dome portion, the circumferential groove having a concave radius of curvature $R_5$ and a maximum depth $D_G$, wherein a ratio of the concave radius of curvature $R_5$ to the maximum depth $D_G$ is within a range of about 0.20 to about 1.0.

27. A plastic container according to claim 21, wherein the main body portion further comprises a plurality of stiffening grooves and a plurality of cylindrical sidewall portions separated by said plurality of stiffening grooves.

28. A plastic container according to claim 21, wherein the third maximum diameter is the same as the second maximum diameter.

29. A plastic container, comprising:

a finish portion defining an opening;

a main body portion comprising a cylindrical sidewall having a first maximum diameter in plan view;

a dome portion between the finish portion and the main body portion, the dome portion having, as viewed in longitudinal section:

an upper end disposed proximate to the finish portion, a lowermost end disposed adjacent to the main body portion, a first convex curved portion defining a first constant radius of curvature, a second convex curved portion defining a second constant radius of curvature that is greater than the first radius of curvature, and a convex curved non-cylindrical transition portion having a transition curvature connecting the first curved portion and the second curved portion, wherein the first convex curved portion extends from the upper end of the dome portion to the transition portion and the second convex curved portion extends from the transition portion to the lowermost end of the dome portion, the dome portion further having a second maximum diameter in plan view that is greater than the first maximum diameter, the second maximum diameter located at or below the transition portion;

a circumferential groove defined proximate to the lowermost end of the dome portion, the circumferential groove having a concave radius of curvature $R_5$ and a maximum depth $D_G$, wherein a ratio of the concave radius of curvature $R_5$ to the maximum depth $D_G$ is within a range of about 0.20 to about 1.0; and a bottom portion having a standing ring and a cylindrical sidewall extending between the main body portion and the standing ring, the cylindrical sidewall having a third maximum diameter.

30. A hot fill plastic container according to claim 29, wherein a ratio of the first radius of curvature to the second radius of curvature is within a range of 0.3 to 0.9.

31. A plastic container according to claim 29, wherein a ratio of the first radius of curvature to the second maximum diameter of the dome portion is within a range of 0.4 to 1.2.

32. A plastic container according to claim 29, wherein a ratio of the first maximum diameter to the second maximum diameter is within a range of 0.8 to 0.99.

33. A plastic container according to claim 29, wherein the first convex portion of the dome portion defines a first vertical height and the second convex portion of the dome portion defines a second vertical height, and wherein a ratio of the first vertical height to the second vertical height is within a range of 1.0 to 7.0.

34. A plastic container according to claim 29, wherein the main body portion further comprises a plurality of stiffening grooves and a plurality of cylindrical sidewall portions separated by said plurality of stiffening grooves.

35. The plastic container according to claim 29, wherein the third maximum diameter is the same as the second maximum diameter.

36. A plastic container, comprising:

a finish portion defining an opening;

a main body portion comprising a cylindrical sidewall having a first maximum diameter in plan view;

a dome portion between the finish portion and the main body portion, the dome portion having, as viewed in longitudinal section:

an upper end disposed proximate to the finish portion, a lowermost end disposed adjacent to the main body portion, a first convex curved portion defining a first radius of curvature $R_1$, a second convex curved portion defining a second radius of curvature $R_2$, wherein $R_2$ is greater than $R_1$, and wherein a ratio of $R_1$ to $R_2$ is within a range of 0.3 to 0.9, and a convex curved non-cylindrical transition portion having a transition curvature connecting the first curved portion and the second curved portion, wherein the first convex curved portion extends from the upper end of the dome portion to the transition portion and the second convex curved portion extends from the transition portion to the lowermost end of the dome portion, the dome portion further having a second maximum diameter in plan view that is greater than the first maximum diameter; and a bottom portion having a standing ring and a cylindrical sidewall extending between the main body portion and the standing ring, the cylindrical sidewall having a third maximum diameter.

* * * * *